US010933956B2

(12) United States Patent
Powers et al.

(10) Patent No.: US 10,933,956 B2
(45) Date of Patent: Mar. 2, 2021

(54) KINETIC INFINITY MOUNT SYSTEM (KIMS)

(71) Applicants: Bryan Austin Powers, Sparks, NV (US); Jenness Donnett Powers, Sparks, NV (US)

(72) Inventors: Bryan Austin Powers, Sparks, NV (US); Jenness Donnett Powers, Sparks, NV (US)

( * ) Notice: Subject to any disclaimer, the term of this patent is extended or adjusted under 35 U.S.C. 154(b) by 0 days.

(21) Appl. No.: 16/460,088

(22) Filed: Jul. 2, 2019

(65) Prior Publication Data

US 2021/0001963 A1 Jan. 7, 2021

(51) Int. Cl.
*B63B 1/00* (2006.01)
*B63B 35/00* (2020.01)
*B63B 32/60* (2020.01)

(52) U.S. Cl.
CPC ..... *B63B 32/60* (2020.02)

(58) Field of Classification Search
CPC ..... B63B 32/00; B63B 32/20; B63B 32/60; B63B 32/70; B63B 32/77; B63B 34/00; B63B 35/7926; B63B 35/793; B63B 2035/79; B63B 35/813
USPC ..... 441/65, 68, 74, 79; 114/39.11, 39.15
See application file for complete search history.

(56) References Cited

U.S. PATENT DOCUMENTS

| | | | | |
|---|---|---|---|---|
| 5,464,359 | A | 11/1995 | Whitty | A63C 15/05 441/79 |
| 7,108,571 | B2 * | 9/2006 | Geraghty | B63B 32/66 441/79 |
| 8,632,373 | B2 * | 1/2014 | Chambers | B63B 32/60 441/79 |
| 9,751,600 | B2 | 9/2017 | Elliott et al. | B63B 1/00 35/793 |
| 9,896,168 | B1 * | 2/2018 | Lindbergh | B63B 32/60 |
| 2015/0239532 | A1 | 8/2015 | Wood | B63B 35/79 441/79 |

* cited by examiner

*Primary Examiner* — Daniel V Venne
(74) *Attorney, Agent, or Firm* — Adibi IP Group, PC; Amir V. Adibi; Andrew C. Palmer

(57) ABSTRACT

A Kinetic Infinity Mount System (KIMS) allows different reusable and removable fins to be mounted into the cavity of a finbox of a surfboard or other waterborne vessels with the dynamic feature of toe in or toe out and camber in or camber out simultaneous or separate adjustments. Toe angle adjustment is accomplished by an outer, square, male gear which can be moved in and out of a female, circular track. At the back of the outer gear is the circular, female gear. Camber angle adjustment is accomplished by moving a front and rear male, circular gear in and out of the female side of the outer gear along the same circular plane as the outer gear. The KIMS allows different types of fins to be mounted into the finbox and then adjusted about its own axis and around a plane.

6 Claims, 11 Drawing Sheets

KINETIC INFINITY MOUNT SYSTEM (KIMS)

TECHNICAL FIELD

The present invention relates generally to water sport equipment.

BACKGROUND INFORMATION

The art of surfing dates back many years. One of the pieces of equipment used to surf is the surfboard. A surfboard fin or skeg attached to the back of the surfboard was introduced in the 1930s as a way to modernize the surfboard. Surfboard fins come in many configurations such as the single fin, the twin fin, the thruster and the quad. The fin is used to drive and lift the surfboard while riding the board on a wave.

SUMMARY

A Kinetic Infinity Mount System (KIMS) comprises an outer housing, first and second outer gears, first and second inner gears, two pins, two screws, two mechanical collars, and a fin box. The fin box includes two screw holes at each end and four screw holes along the side. These parts are configured in such a manner to allow users to choose from multiple settings of positive or negative toe angle for each fin mounted into the surfboard. In addition, the KIMS provides the user the ability to adjust camber angle utilizing multiple settings either positive or negative for each fin mounted into the surfboard. Camber and toe angles, in both positive or negative directions, can be adjusted simultaneously or separately to the user's preference.

The teeth on the outer housing allow for movement of 90 degrees of camber and/or 60 degrees of total toe movement. Alternatively, when the fin box is set in the neutral camber/neutral toe position, as shown in FIGS. 4A-4B, the fin box has a movement range between 30 degrees toe positive (away from the surfboard nose) and 30 degrees toe negative (towards the nose of the surfboard). The camber from the neutral position, as shown in FIGS. 4A-4B, can be adjusted up to 45 degrees away from the nose of the surfboard or negative 45 degrees towards the nose of the surfboard. It is understood that these prescriptive degree values are subject to change due to manufacturer's capabilities and/or customer requests.

The fin box is also referred to as a "universal fin box" because the fin box fits any type of fin. For example, the KIMS fin box accepts FCS®, FCS II® and Futures® fins or similar, rectangular based fins. The fin manufactured by FCS® or Futures® can be attached to the fin box with a hex key (allen wrench). The fin is fastened to the fin box using hexagonal head screws. The novel fin box allows various fins (e.g.—FCS®, FCS II® and Futures®) to all be attached using the same method.

Fins throughout the history of surfing have been static, meaning once the fins were set in the board the user could not change the fin position. The KIMS is the first fin system to allow the user to have fully dynamic fin movement capabilities of fin toe movement of left to right and fin camber tilting movement of left and right. The KIMS will also be the first of its kind to allow the user to attach the fin to the fin box using a hex key utilizing the same method for similar, rectangular based fins.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1A:
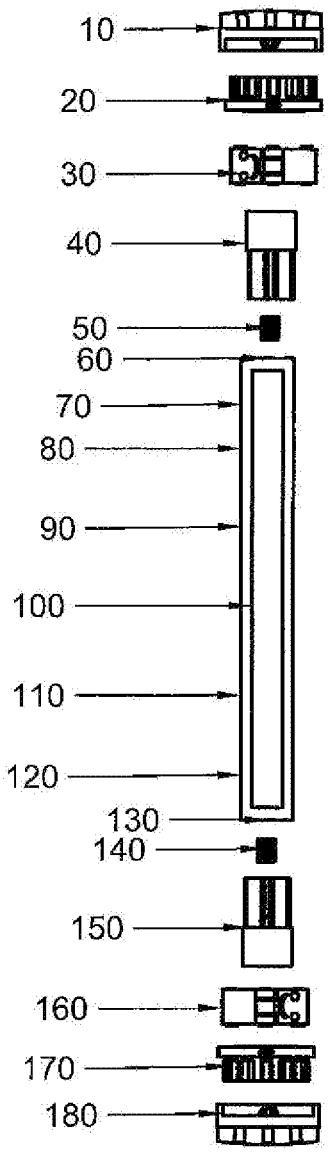
FIG. 1A is a diagram showing the components of the Kinetic Infinity Mount System (KIMS) including an outer housing and a fin.

Reference will now be made in detail to some embodiments of the invention, examples of which are illustrated in the accompanying drawings.

FIG. 1 is a diagram showing the Kinetic Infinity Mount System (KIMS) having an outer housing 190. The outer housing has an hourglass shape. The outer housing 190 has two triangular pieces cut out on the sides and teeth along the top and bottom of the outer edge on the inside of the outer housing. The outer housing 190 holds a first outer gear 10 and a second outer gear 180. Each of the first outer gear 10 and the second outer gear 180 has two sides, a male side and a female side.

The male sides of the first outer gear 10 and the second outer gear 180 are shaped like a square with teeth along the top and bottom which fit into the outer housing 190 to control toe in/toe out. The outer housing 190 has an hourglass shape. The female sides of the first outer gear 10 and the second outer gear 180 have circular shapes and mate with the first inner gear 20 and the second inner gear 170, respectively, in a circular pattern fashion. The female side of the first outer gear 10 accepts the male side of the first inner gear 20 and the female side of the second outer gear 180 accepts the second inner gear 170 as shown in the exploded views of FIGS. 1A- and 1C.

The first inner gear 20 and the second inner gear 170 control the camber in/camber out. The first outer gear 10 and the first inner gear 20 attach to a first pin 40. The second outer gear 180 and the second inner gear 170 attach to a second pin 150. The first and second pins 40 and 150 attached to the fin box 90. A fin 100, which may be any type of fin including fins from FCS® (FCS® and FCS II®) and Futures® or similar, is fastened to the fin box 90. Various types of fins 100 can be attached via screws to the fin box 90 via the holes provided on the side of the fin box 90, including holes 70, 80, 110 and 120.

Figure 1B:
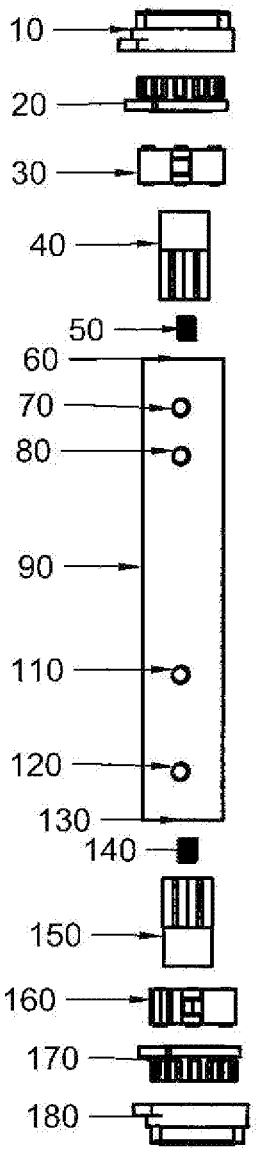
FIG. 1B is a diagram showing another embodiment of the KIMS.
Figure 1C:
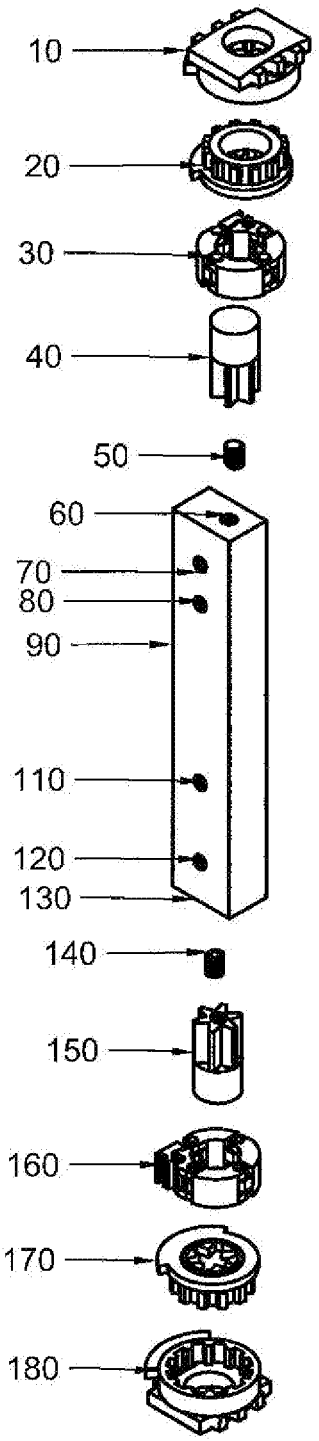
FIG. 1C shows an isometric view of the KIMS embodiment shown in FIG. 1B.
Figure 2A:
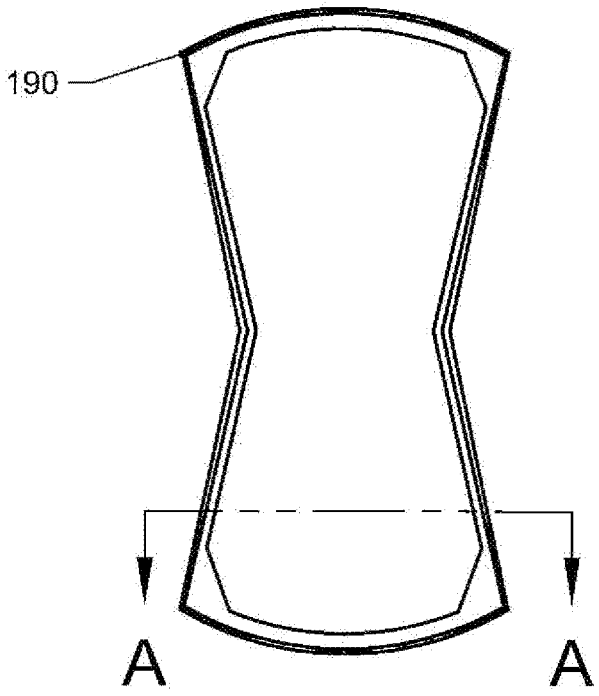
FIG. 2A is a plan view illustration of the outer housing of the KIMS.
Figure 2B:
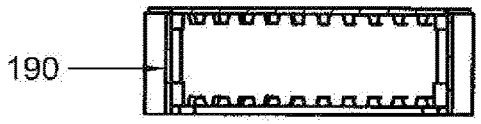
FIG. 2B is a cross-sectional view of the outer housing of the KIMS that shows teeth.
Figure 3:
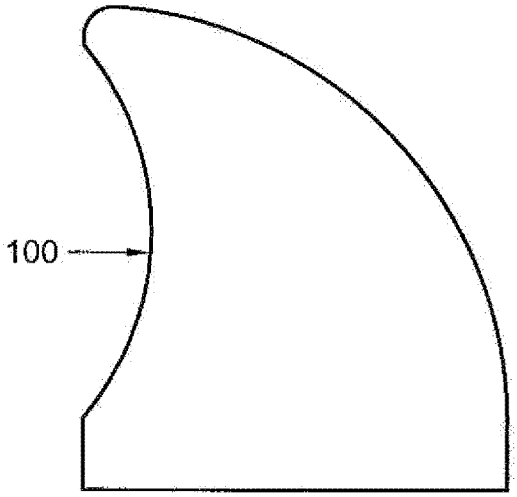
FIG. 3 is an illustration of a fin or surfboard skeg or fin.
Figure 4A:
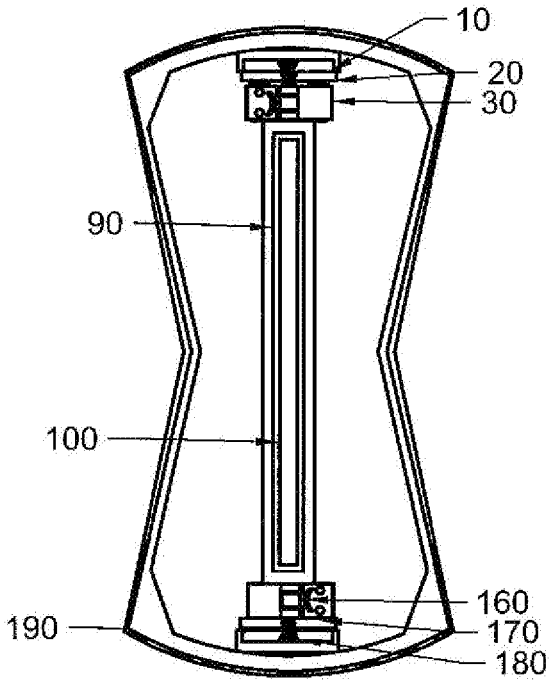
FIG. 4A is a plan view illustration of the KIMS fin box depicting both camber and toe set in the neutral direction.
Figure 4B:
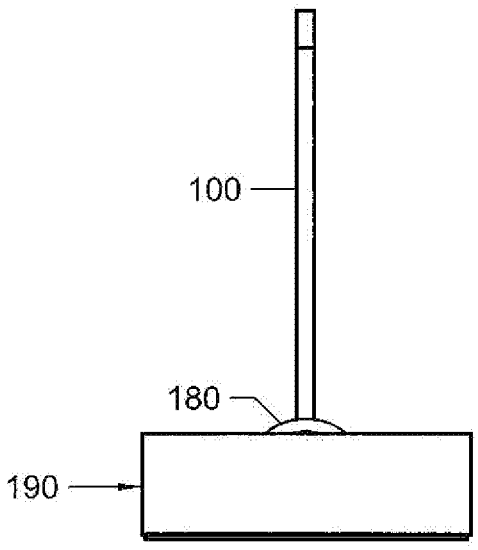
FIG. 4B is a transverse view illustration of the KIMS fin box depicting both camber and toe set in Lhe neutral direction.
Figure 5A:
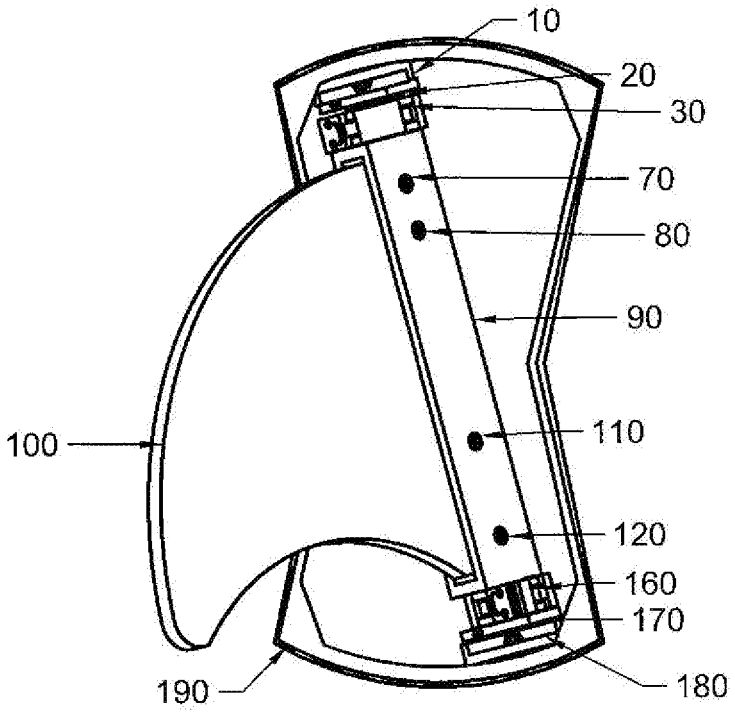
FIG. 5A is a plan view illustration of the KIMS fin box depicting both camber and toe set in a positive direction.
Figure 5B:
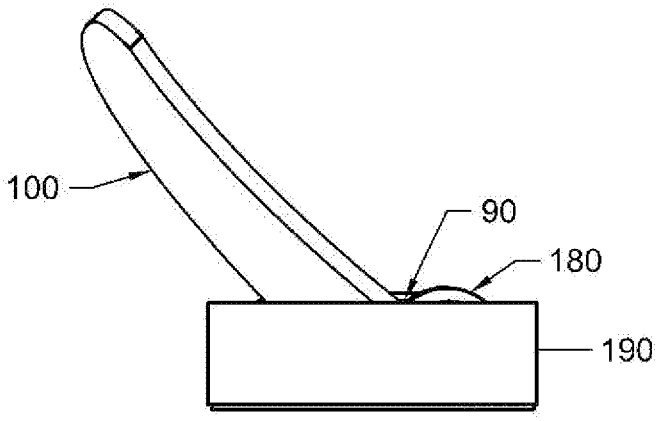
FIG. 5B is a transverse view illustration of the KIMS fin box depicting both camber and toe set in a positive direction.
Figure 6A:
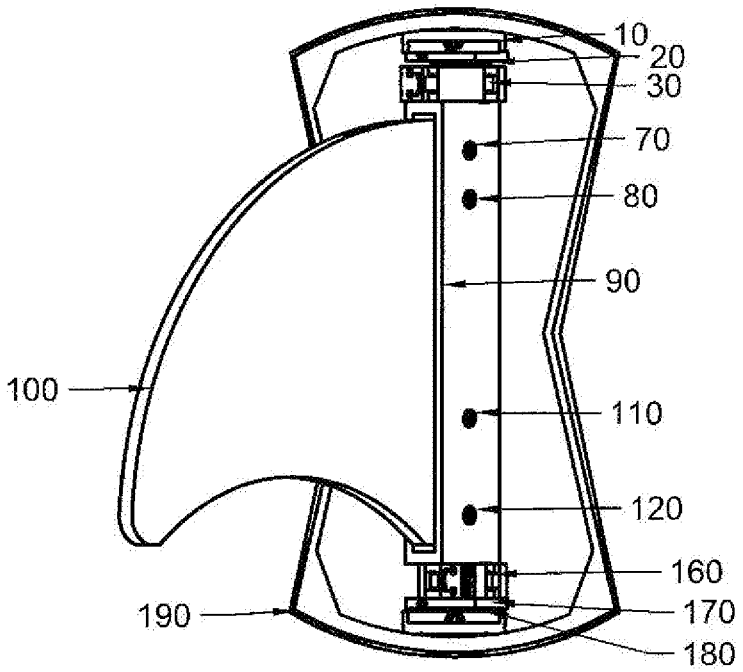
FIG. 6A is a plan view illustration of the KIMS fin box depicting camber set in a positive direction and toe set in a neutral direction.
Figure 6B:
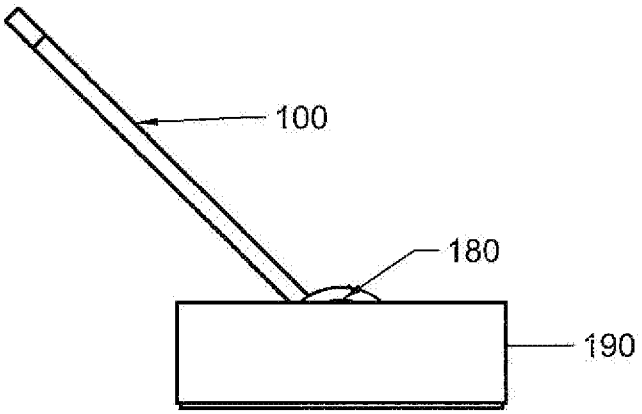
FIG. 6B is a transverse view illustration of the KIMS fin box depicting camber set in a positive direction and toe set in a neutral direction.
Figure 7A:
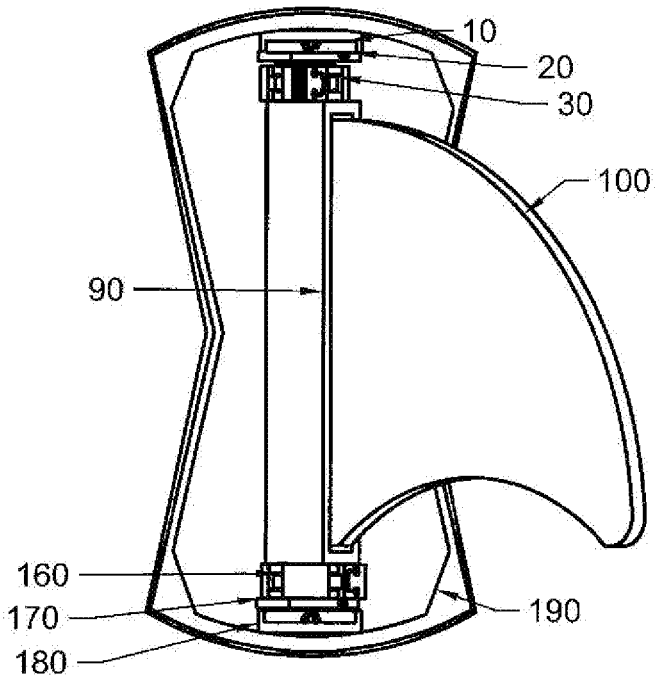
FIG. 7A is a plan view illustration of the KIMS fin box depicting camber set in a negative direction and toe set in a neutral direction.
Figure 7B:
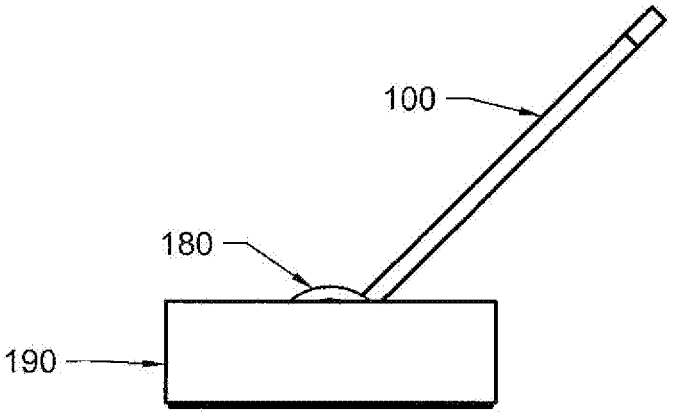
FIG. 7B is a transverse view illustration of the KIMS fin box depicting camber set in a negative direction and toe set in a neutral direction.
Figure 8A:
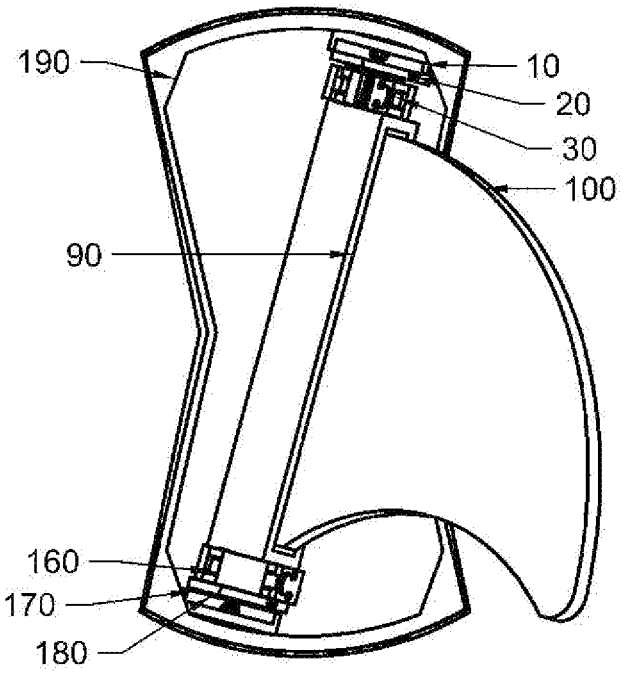
FIG. 8A is a plan view illustration of the KIMS fin box depicting both camber and toe set in a negative direction.
Figure 8B:
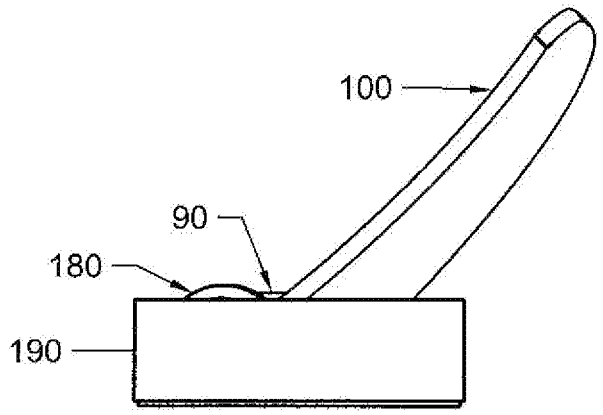
FIG. 8B is a transverse view illustration of the KIMS fin box depicting both camber and toe set in a negative direction.
Figure 9A:
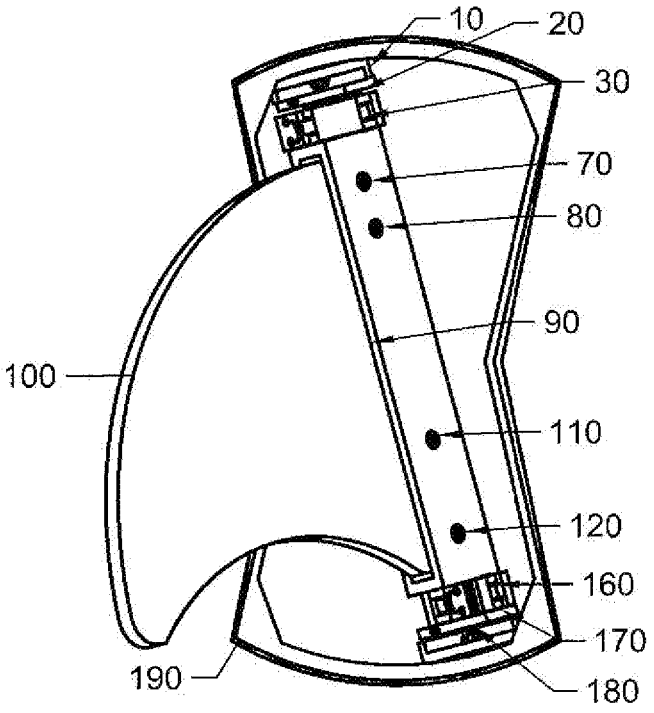
FIG. 9A is a plan view illustration of the KIMS fin box depicting both camber and toe set in a positive direction.
Figure 9B:
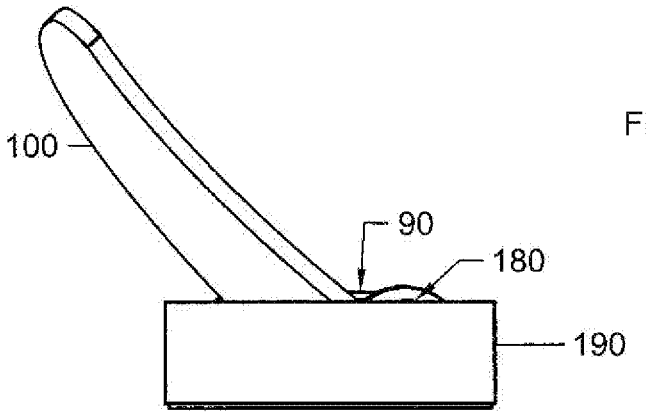
FIG. 9B is a transverse view illustration of the KIMS fin box depicting both camber and toe set in a positive direction.
Figure 10A:
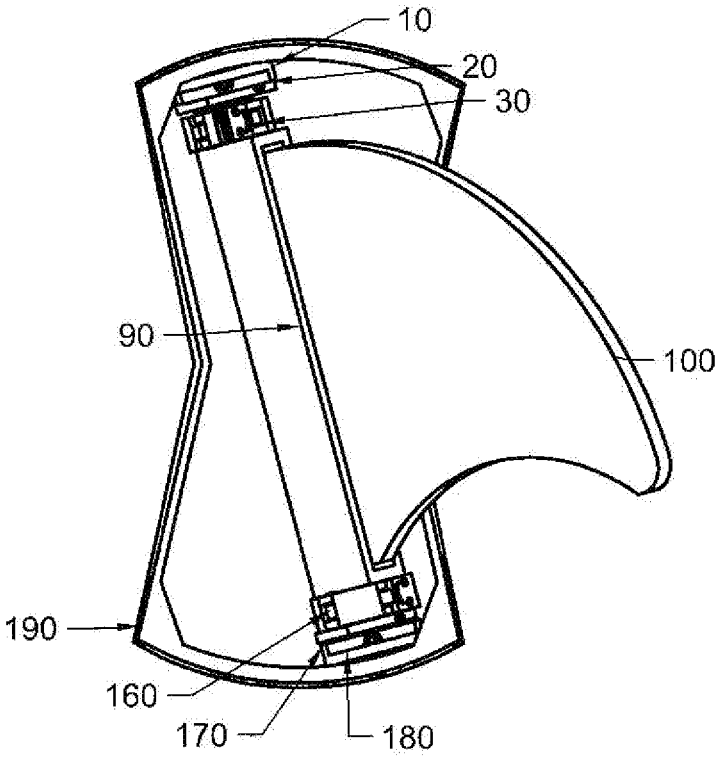
FIG. 10A is a plan view illustration of the KIMS fin box depicting camber set in a negative direction and toe set in a positive direction.
Figure 10B:
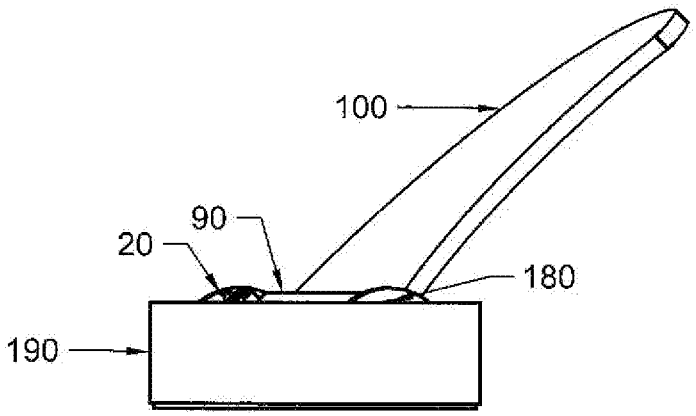
FIG. 10B is a transverse view illustration of the KIMS fin box depicting camber set in a negative direction and toe set in a positive direction.
Figure 11A:
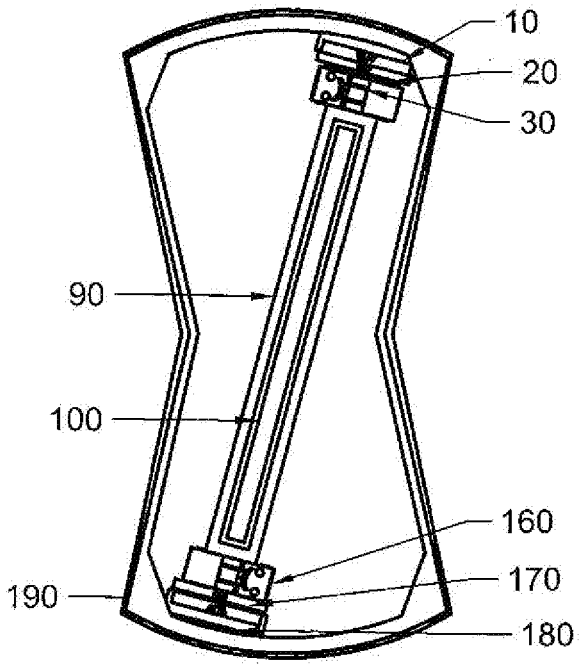
FIG. 11A is a plan view illustration of the KIMS fin box depicting camber set in a neutral direction and toe set in a negative direction.
Figure 11B:
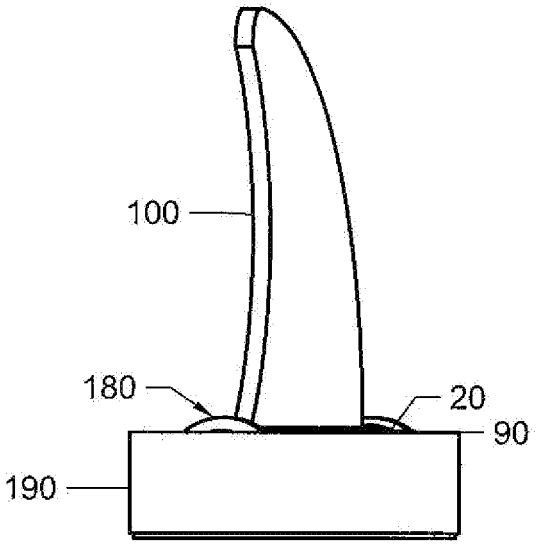
FIG. 11B is a transverse view illustration of the KIMS fin box depicting camber set in a neutral direction and toe set in a negative direction.
Figure 12A:
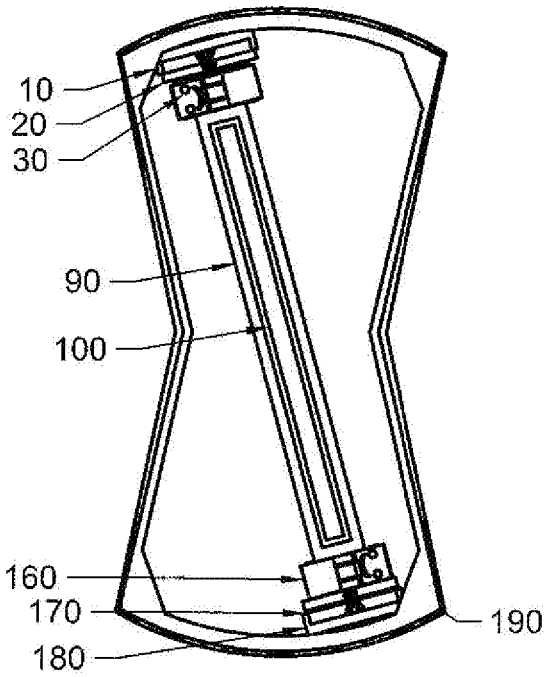
FIG. 12A is a plan view illustration of the KIMS fin box depicting camber set in a neutral direction and toe set in a positive direction.
Figure 12B:
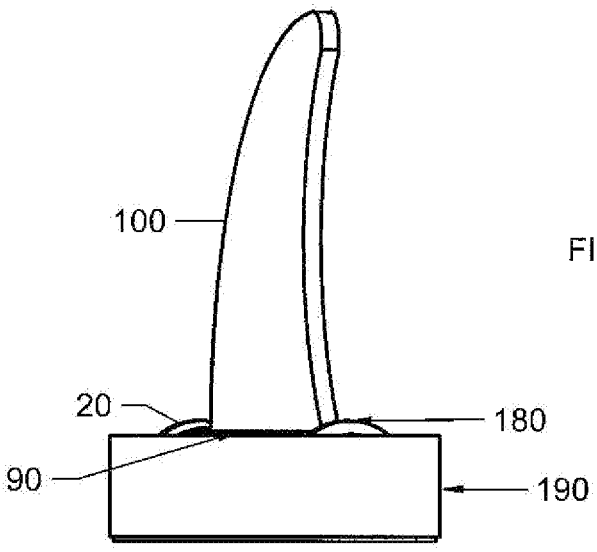
FIG. 12B is a transverse view illustration of the KIMS fin box depicting camber set in a neutral direction and toe set in a positive direction.

The first pin 40 and the second pin 150 pin are cylindrically shaped on one end while the other end is shaped like a star as shown in FIGS. 1A-1C. The star-shaped sides of the first pin 40 and the second pin 150 are attached to the fin box 90 via screws 50 and 140, respectively. The screws 50 and 140 are threaded into the fin box 90 via holes 60 and 130 into the first pin 40 and the second pin 150. The star portion of the first and second pins 40 and 150 allow the first and second inner gears 20 and 170 to move back and forth, but prevent the first and second inner gears 20 and 170 from sliding off the pins. The cylindrical side of the first and second pins 40 and 150 allow the first and second outer gears 10 and 180 to slide completely along the entire length of the pins 40 and 150 including the star-shaped side. The novel design of the fin mount system allows movement of the first and second outer gears 10 and 180 and allows movement of the first and second inner gears 20 and 170 simultaneously during toe in/toe out. This allows the fin box 90 to be moved and locked in place along a longitudinal axis in a negative direction also known as negative camber where the fin 100 can point towards the nose of the surfboard or in a positive direction also known as positive camber where the fin can point away from the nose of the surfboard as in FIGS. 5A through 12B.

The first and second inner gears 20 and 170 slide along the first and second pins 40 and 150 to change the toe angle of the fin by removing first and second collars 30 and 160. The camber angle of the fin 100 is set by the first and second inner gears 20 and 170 rotating along the first and second pins 40 and 150, respectively, about a horizontal axis of the fin box 90. The camber is adjusted by sliding only the first and second inner gears 20 and 170 along the first and second pins 40 and 150, respectively. The novel design of the fin mount system allows teeth movement of the first and second inner gears 20 and 170 during camber in/camber out. This allows the fin box 90 to be moved and locked in place along a horizontal axis in a negative direction where the fin 100 can point towards the nose of the surfboard or a positive direction where the fin can point away from the nose of the surfboard as shown in FIGS. 5A through 12B. Both the toe and camber can be adjusted simultaneously or separately for desired fin movement and configuration.

The first and second collars 30 and 160 are disposed in between a respective one of the first and second inner gears 20 and 170 and the fin box 90. The first and second collars 30 and 160 clasp around the respective first and second pins 40 and 150 in a manner that prevents longitudinal or front to back movement of the first or second outer gears 10 and 180 or movement of the first or second inner gears 20 and 170. The first and second collars 30 and 160 lock the fin box 90 into place once the desired camber/toe has been selected and adjusted.

The invention claimed is:

1. A fin mount system for a surfboard comprising:
- an outer housing having an inside and an outside;
- a fin box, wherein the fin box is disposed within the inside of the outer housing;
- a first outer gear;
- a second outer gear, wherein the first outer gear and the second outer gear control a toe angle of the fin box;
- a first inner gear; and
- a second inner gear, wherein the first inner gear and the second inner gear control a camber angle of the fin box.

2. The fin mount system of claim 1, wherein the outer housing includes mechanical teeth along the inside of the outer housing, wherein the first outer gear and second outer gear include mechanical teeth that mate with the mechanical teeth of the outer housing, and wherein the toe angle is set by adjusting where along the mechanical teeth of the outer housing the first outer gear and second outer gear mate.

3. The fin mount system of claim 1, wherein the first outer gear has a first side and a second side, wherein the first side is opposite the second side, wherein the first side of the first outer gear attaches to the outer housing, and wherein the second side of the first outer gear attaches to the first inner gear, and wherein the camber angle is adjusted by rotating the first inner gear and mating first inner gear with the first outer gear.

4. The fin mount system of claim 1, wherein the fin box comprises:
- a first hole on a side of the fin box;
- a second hole on the side of the fin box;
- a third hole on the side of the fin box; and
- a fourth hole on the side of the fin box, wherein a fin is insertable into the fin box and secured via at least two of first, second, third, and fourth holes.

5. The fin mount system of claim 1, further comprising:
- a first pin, wherein the first pin is attached to a first end of the fin box, and wherein the first inner gear and the first outer gear are slidable along the first pin; and a second pin, wherein the second pin is attached to a second end of the fin box, and wherein the second inner gear and the second outer gear are slidable along the second pin.

6. The fin mount system of claim 1, wherein the outer housing has an hourglass shape.

* * * * *